US005454285A

United States Patent [19]

Ishikawa et al.

[11] Patent Number: 5,454,285

[45] Date of Patent: Oct. 3, 1995

[54] APPARATUS FOR FINISHING SLIDE FASTENERS

[75] Inventors: Kiichiro Ishikawa; Chet Dudek, both of Marietta; James Hutcherson, Kennesaw; Jonathan C. Colier, Marietta, all of Ga.

[73] Assignee: Yoshida Kogyo K.K., Tokyo, Japan

[21] Appl. No.: 121,256

[22] Filed: Sep. 15, 1993

[51] Int. Cl.[6] ..... B26D 5/28

[52] U.S. Cl. ..... 83/210; 83/212; 83/371; 83/921; 29/766

[58] Field of Search ..... 83/209, 210, 211, 83/212, 365, 371, 921, 277; 29/33.2, 408, 766

[56] References Cited

U.S. PATENT DOCUMENTS

| | | | |
|---|---|---|---|
| 3,005,581 | 10/1961 | Burbank | 83/921 X |
| 3,776,078 | 12/1973 | Perlman | 83/210 |
| 4,043,232 | 8/1977 | Jovin | 83/13 |
| 4,250,781 | 2/1981 | Nakamura | 83/210 |
| 4,459,884 | 7/1984 | Yoshieda et al. | 83/42 |
| 4,520,544 | 6/1985 | Morita et al. | 29/408 |
| 4,551,900 | 11/1985 | Hansen et al. | 29/408 |
| 4,616,539 | 10/1986 | Horikawa | 83/42 |
| 4,756,079 | 7/1988 | Kando | 29/33.2 X |
| 4,771,522 | 9/1988 | Osaki | 29/33.2 |
| 4,839,963 | 6/1989 | Akiyama et al. | 29/766 |
| 5,101,551 | 4/1992 | Rademacher et al. | 83/921 X |
| 5,168,785 | 12/1992 | Yunoki | 83/921 X |

*Primary Examiner*—Eugenia Jones
*Attorney, Agent, or Firm*—Hill, Steadman & Simpson

[57] ABSTRACT

An improved apparatus for finishing slide fasteners by cutting off an elongate slide fastener chain across longitudinally spaced element-free spaces is provided wherein a slider arresting mechanism is disposed between a cutting mechanism and a feed mechanism and movable into and out of a path of travel of the slide fastener chain for temporarily arresting a slide fastener against downstream movement while the slide fastener chain is being fed by the feed mechanism, and a detecting mechanism is operatively connected with the slider arresting mechanism for detecting the engagement between an end stop and the slider which occurs when the slide fastener chain is fed by the feed mechanism while the slider is being arrested by the slider arresting mechanism. The detecting mechanism is operative, upon detection of the engagement between the end stop and the slider, to stop the operation of the feed mechanism to terminate the feed of the slide fastener chain and activate the cutting mechanism to perform its cutting operation.

7 Claims, 6 Drawing Sheets

APPARATUS FOR FINISHING SLIDE FASTENERS

BACKGROUND OF THE INVENTION

1. Field of the Invention

The present invention relates to an apparatus for finishing slide fasteners by cutting off an elongate, substantially endless slide fastener chain across longitudinally spaced element-free gaps. The slide fastener chain which can be processed by the apparatus is of the type having a plurality of pairs of rows of coupling elements longitudinally spaced by the element-free gaps, at least one slider slidably mounted on each pair of the rows of coupling elements, and an end stop mounted on one end of the coupling element rows of each pair and engageable with the slider when the slider moves in a direction to interengage the coupling element rows.

2. Description of the Prior Art

Typical examples of prior slide fastener finishing apparatus are disclosed in U.S. Pat. No. 4,459,884, issued on Jul. 17, 1984 and U.S. Pat. No. 4,520,544, issued on Jun. 4, 1985. Each of the disclosed prior apparatus includes a cutting mechanism for cutting off the slide fastener chain across one of the element-free gaps to produce a slide fastener, a feed mechanism disposed downstream of the cutting mechanism for feeding the slide fastener chain along a path of travel, and a feedout mechanism disposed upstream of the cutting mechanism for feeding the slide fastener chain to the feed mechanism.

In operation, the feedout mechanism and the feed mechanism cooperate to feed the slide fastener chain downstream along the path of travel until an element-free gap of the slide fastener chain arrives at the cutting mechanism. Upon arrival of the element-free gap at the cutting mechanism, feeding of the slide fastener chain is stopped and the cutting mechanism is operated to cut off the slide fastener chain across the element-free gap. In order to position the element-free gap relative to the cutting mechanism and to stop the feed of the slide fastener chain, there is provided a chain stopper which is movable into and out of the path of travel of the slide fastener chain at a position immediately upstream of the cutting mechanism. The chain stopper is operatively connected with the feed mechanism and the cutting mechanism to control the operation of these mechanisms in a manner described below in brief.

As the slide fastener chain is fed by the feed mechanism, a leading one of the element-free gaps approaches the cutting mechanism. At this time, the chain stopper projects into the leading element-free gap. As the slide fastener chain further advances, a leading end of the succeeding pair of rows of interengaged coupling elements is brought into abutment with the chain stopper, whereupon the chain stopper detects the arrival of the leading element-free gap at a predetermined position in the cutting mechanism. With this detection by the chain stopper, the feed mechanism is stopped to terminate the advancing movement of the slide fastener chain, and the cutting mechanism is activated to cut off the slide fastener chain across the leading element-free gap to produce a slide fastener.

Since the leading end of each pair of rows of interengaged coupling elements is brought into abutment with the chain stopper, the row of interengaged coupling elements may be disengaged or separated from the leading end upon abutting engagement with the chain stopper. In order to avoid such coupling-element separation, the slide fastener chain must be provided with a bridge type end stop secured to the leading end of the coupling element rows of each pair. This type of slide fastener chain is illustrated here in FIG. 10 of the accompanying drawings, wherein bridge type end stops are denoted by ES6.

Accordingly, if the prior slide fastener finishing apparatus is used with a slide fastener chain FC1 shown in FIG. 7, the chain stopper cannot operate reliably because the slide fastener chain FC1 is provided with two pairs of separate end stops ES1, ES2 secured to the opposite ends of each pair of rows of interengaged coupling elements 111. Even if the rows of coupling elements of each pair is provided with a bridge type end stop at its leading end, the bridge type end stop is likely to be damaged due to concentration of force occurring when the bridge type end stop abuts on the chain stopper. This is because the chain stopper has a thin blade-like configuration in view of the necessity that it must be insertable in a narrow element-free-gap defined between a pair of opposed stringer tapes of the slide fastener chain.

SUMMARY OF THE INVENTION

With the foregoing difficulties in view, it is an object of the present invention to provide an apparatus which is capable of finishing slide fasteners by cutting off an elongate slide fastener chain across longitudinally spaced element-free gaps, regardless of the number of the slider mounted on each pair of rows of coupling elements and the type of the end stop attached to at least one end of the rows of coupling elements of each pair.

According to the present invention, an apparatus for finishing slide fasteners includes a cutting mechanism for cutting off an elongate slide fastener chain across one of longitudinally spaced element-free gaps to produce a slide fastener, a feed mechanism disposed downstream of the cutting mechanism for feeding the slide fastener chain along a path of travel, and a feedout mechanism disposed upstream of the cutting mechanism for feeding the slide fastener chain past the cutting mechanism to the feed mechanism, with one end of each pair of rows of coupling elements rows ahead of the other end thereof on which an end stop is mounted for engagement with a slider slidably mounted on the coupling element rows. The apparatus further includes a slider arresting mechanism disposed between the cutting mechanism and the feed mechanism and movable into and out of the path of travel of the slide fastener chain for temporarily arresting the slide fastener against downstream movement while the slide fastener chain is being fed by the feed mechanism. A detecting mechanism is operatively connected with the slider arresting mechanism for detecting the engagement between the end stop and the slider which occurs when the slide fastener chain is fed by the feed mechanism while the slider is being arrested by the slider arresting mechanism. The detecting mechanism is operative, upon detection of the engagement between the end stop and the slider, to stop the operation of the feed mechanism to terminate the feed of the slide fastener chain and activate the cutting mechanism to perform its cutting operation.

The slider arresting mechanism may be composed of a pair of grip arms disposed on opposite sides of the path of travel of the slide fastener and movable toward and away from each other to grip the slider therebetween. One of the grip arms has an L-shaped slider arresting seat slidably mounted on a body of said one grip arm, and a spring means for urging the slider arresting seat in a first direction opposite to a direction of feed of the slide fastener chain. The slider arresting seat is displaceable against the force of the spring means in the direction of feed of the slide fastener when the slide fastener chain is fed, with the end stop engaged by the slider being supported on the slider arresting seat. The detecting means is responsive to the displacement of the slider arresting seat in the direction of feed of the slide fastener chain. The slider arresting seat has a step engageable with a portion of the slider, and the other grip arm includes a stepped surface having a shoulder engageable with a portion of the slider. The shoulder is normally displaced from the step of the slider arresting seat in the direction of feed of the slide fastener chain, the shoulder being aligned with the step when the slider arresting seat is displaced.

The detecting mechanism may include a lever having a first end engageable with the slider arresting seat, and a photosensor disposed near a second end of the lever opposite the first end, the photosensor being activated when the lever is turned in one direction by the slider arresting seat.

The apparatus may further include a chain feed mechanism disposed upstream of the feedout mechanism for positively feeding the slide fastener chain toward the feedout mechanism to release an undue tension on the slide fastener chain which may be applied while the slide fastener chain is fed by the feedout mechanism or the feed mechanism. The chain feed mechanism preferably comprises a first guide roller, a second guide roller spaced downstream from the first guide roller along the path, and a continuously rotating drive roller disposed between the first and second guide rollers. These rollers are arranged such that the slide fastener chain extends meanderingly around the first guide roller, the drive roller and the second guide roller.

The feed mechanism may be composed of a first feed unit and a second feed unit disposed in tandem relation along the path of travel of the slide fastener chain. The first feed unit is disposed closer to the cutting unit than the second feed unit and operative to feed the slide fastener chain at a first speed. The second feed unit is operative to feed the slide fastener chain and each of the slide fasteners at a second speed higher than the first speed.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
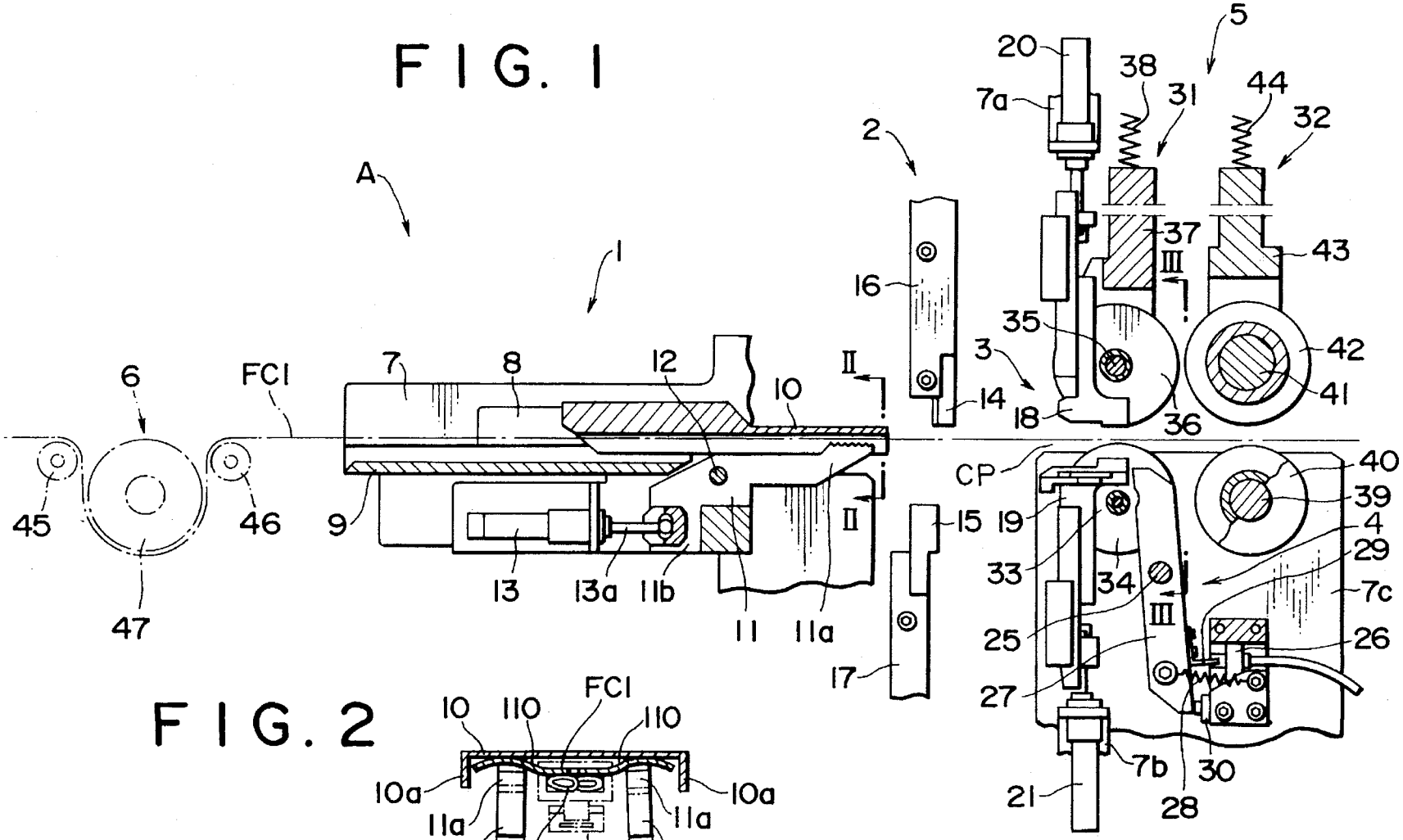
FIG. 1 is a fragmentary front elevational view, partly in cross section, and partially broken away for the sake of clarity, of an apparatus for finishing slide fasteners according to the present invention.

The present invention is particularly useful when embodied in an apparatus A, for automatically finishing slide fasteners, as illustrated in FIG. 1.

The apparatus A generally comprises a feedout mechanism 1 for feeding out a slide fastener chain FC1, a cutting mechanism 2 for cutting off the slide fastener chain FC1 into individual slide fasteners, a slider arresting mechanism 3 for temporarily arresting a slider threaded on each pair of rows of coupling elements of the slide fastener chain FC1, a detecting mechanism 4 operatively connected with the slider arresting mechanism 3, and a feed mechanism 5 for feeding the slide fastener chain FC1 along a horizontal path of travel (hereinafter referred to as "chain path CP"). In FIG. 1, reference numeral 6 designates a chain feed mechanism for positively feeding the slide fastener chain FC1 toward the feedout mechanism 1 so as to release an undue tension on the slide fastener chain FC1 which may be applied while the slide fastener chain FC1 is being fed along the chain path CP. Construction and operation of the chain feed mechanism 6 will be described later in greater detail.

Figure 7:
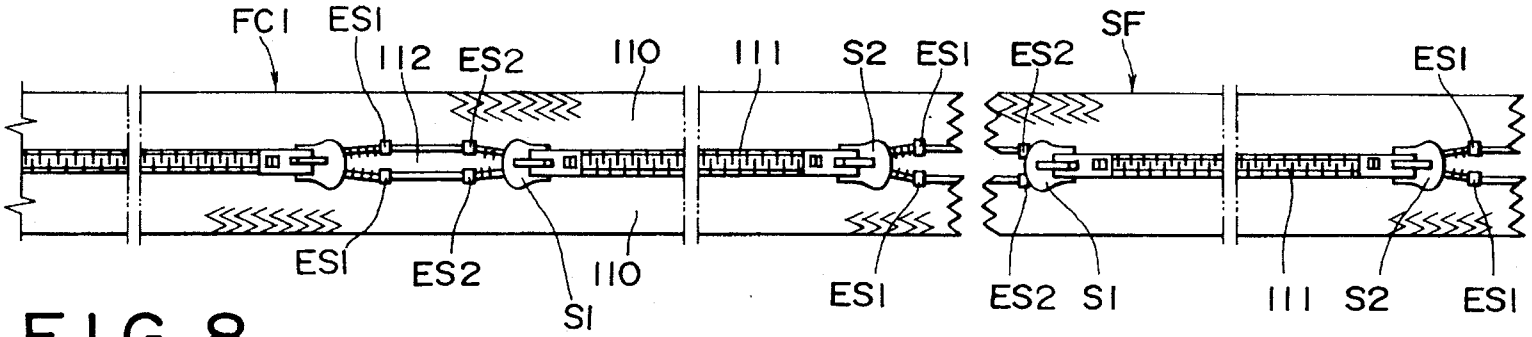
FIGS. 7 through 11 are fragmentary plan views showing various types of slide fastener chains which can be processed on the slide fastener finishing apparatus of the present invention.

The slide fastener chain FC1 which will be process by the apparatus A into slide fasteners of a product length is illustrated in FIG. 7. The slide fastener chain FC1 comprises a pair of elongate slide fastener stringer tapes 110, 110 supporting thereon a plurality of pairs of rows of partly interengaged coupling elements 111 of metal or synthetic resin longitudinally spaced along the stringer tapes 110, 110 with element-free spaces or gaps 112 therebetween. Each pair of the coupling element rows 111 has a pair of independent or separate first end stops ES1, ES1 secured at one end thereof and a pair of separate second end stops ES2, ES2 secured at the other end. The coupling elements 111 of each row can be brought into and out of mutual intermeshing engagement by first and second sliders S1, S2 threaded on the coupling element rows 111. The first and second sliders S1, S2 are disposed in back-to-back confrontation, so that the coupling element rows 111 can be separated or opened from the opposite directions in response to the sliding movement of the sliders S1, S2 in a direction toward each other. The slide fastener chain FC1, with the first end stops ES1 located ahead of the second end stops ES2 on the same coupling element row, is introduced into the apparatus A and then fed downstream along the chain path CP.

The feedout mechanism 1 shown in FIG. 1 is operative to feed the slide fastener chain FC1 into the feed mechanism 5 through the cutting mechanism 2 by gripping the leading end of the slide fastener chain FC1. The feedout mechanism 1 comprises a slide ram 8 slidably mounted on a frame 7 of the apparatus A for reciprocating movement along the chain path CP, the slide ram 8 being driven by a suitable drive means (not shown). The slide ram 8 supports thereon a fixed elongate chain guide 9, an elongate bearing plate 10 extending downstream along the chain path CP to a position near the cutting mechanism 2, and a pair of grippers 11, 11 (see FIG. 2).

The chain guide 9 extends along the chain path CP for guiding therealong the slide fastener chain FC1 and the sliders S1, S2.

Figure 2:
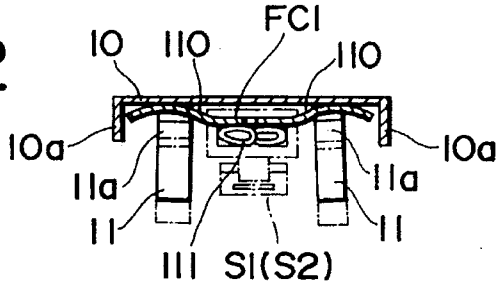
FIG. 2 is an enlarged cross-sectional view taken along line II—II of FIG. 1.

The grippers 11, 11 are rotatably supported on a shaft 12 mounted on the slide ram 8 at a downstream position thereof below the chain path CP and immediately downstream of the chain guide 9. As shown in FIG. 2, the grippers 11, 11 are laterally spaced each other transversely across the chain path CP, so as to permit the sliders S1, S2 to pass through a space between the grippers 11, 11 without interference with the grippers 11, 11. The grippers 11, 11 have distal ends 11*a*, 11*a*, respectively, extending downstream and terminating short of the cutting mechanism 2. When the grippers 11, 11 are operated, the distal ends 11*a*, 11*a* thereof are angularly moved toward the bearing plate 10 to grip the leading ends of the stringer tapes 110 of the slide fastener chain FC1. The grippers 11, 11 have rear ends 11*b* connected together, and a joint portion between the rear ends 11*b* is connected to a piston rod 13*a* of a fluid-pressure cylinder actuator 13 mounted on the slide ram 8. The distal ends 11*a*, 11*a* are normally retracted out of the chain path CP, as indicated by the phantom lines shown in FIG. 2. When the slide fastener chain FC1 is to be fed out, the grippers 11, 11 are angularly moved counterclockwise (FIG. 1) about the shaft 12 by the cylinder actuator 13 to enable the distal ends 11*a*, 11*a* to hold the stringer tapes 110, 110 against the bearing plate 10.

The bearing plate 10 is positioned upwardly of the chain path CP and has a pair of guide walls 10*a*, 10*a* (FIG. 2) depending from the opposite longitudinal edges thereof. With the bearing plate 10 thus constructed, the slide fastener chain FC1 is guided stably and accurately as it is fed toward the cutting mechanism 2.

The cutting mechanism 2 comprises, as shown in FIG. 1, a pair of upper and lower cutter blades 14, 15 that is coactive to cut off or sever the slide fastener chain FC1. The upper cutter blade 14 is fixed to a fixed holder 16, and a lower cutter blade 15 is secured to a holder 17 vertically movable by a suitable drive means (not shown). When the lower cutter blade 15 is disposed in a downwardly retracted position, the upper and lower cutter blades 14, 15 are vertically spaced by such a distance that the feedout mechanism 1 is reciprocally movable toward and away from the feed mechanism 5 through a space between the upper and lower cutter blades 14, 15 of the cutter mechanism 2. The cutting mechanism 2 is the same, in construction and operation, as the conventional cutting mechanism and, hence, a further description thereof will be omitted.

Figure 4:
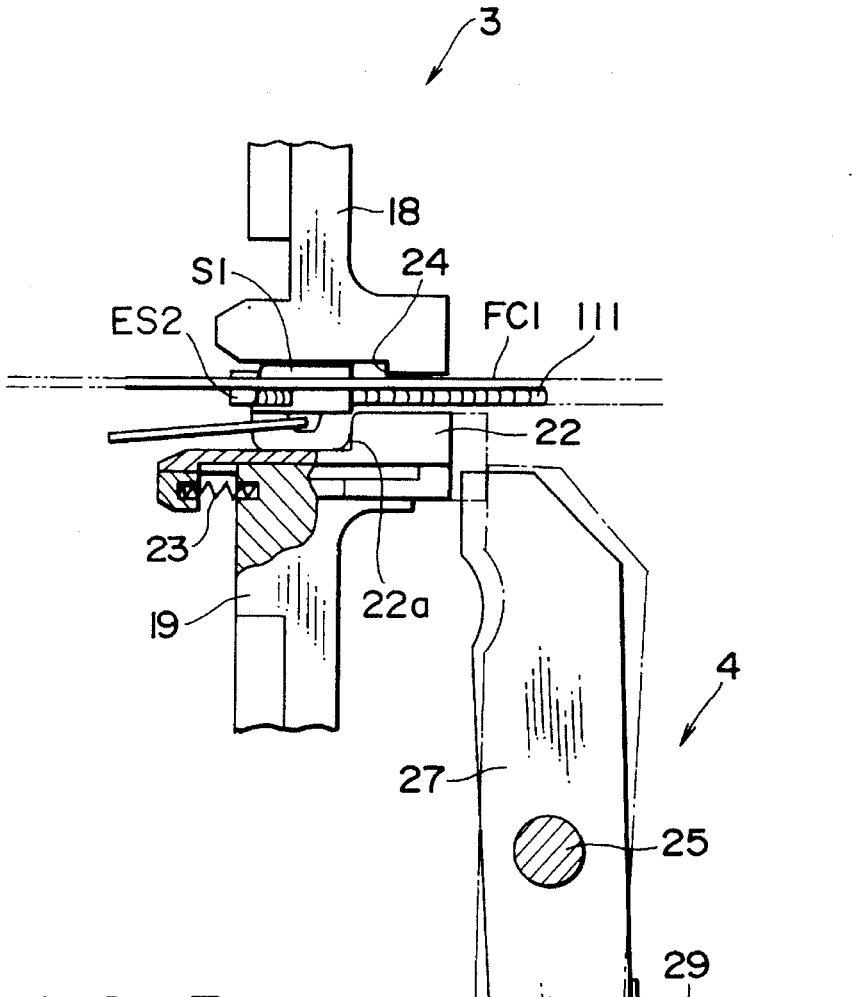
FIG. 4 is a fragmentary front elevational view, with parts in broken away for the sake of clarity, of a slider arresting mechanism and a detecting mechanism of the slide fastener finishing apparatus.

The slider arresting mechanism 3 is operative to place or set one of the element-free gaps 112 (FIG. 7) of the slide fastener chain CF1 in a predetermined position in the cutting mechanism 2 for enabling the cutting mechanism 2 to subsequently cut off the slide fastener chain FC1 across the one element-free gap 112 to produce a slide fastener. The slider arresting mechanism 3 is disposed at a position spaced downstream of the cutting mechanism 2 by a predetermined distance. As shown in FIGS. 1 and 4, the slider arresting mechanism 3 includes a pair of upper and lower grip arms 18, 19 positioned, respectively, upwardly and downwardly of the chain path PC. The upper grip arm 18 is connected to a piston rod (not designated) of a vertically disposed fluid-pressure cylinder actuator 20 secured to a portion 7*a* of the frame 7. Similarly, the lower grip arm 19 is connected to a piston rod (not designated) of a vertically disposed fluid-pressure cylinder actuator 21 secured to a portion 7*b* of the frame 7.

With this construction, the upper and lower grip arms 18, 19 are vertically movable toward and away from each other in response to the operation of the cylinder actuators 20, 21 so that the grip arms 18, 19 project into and retract from the chain path CP. When they are fully advanced, the slider S1 on the rows of partly interengaged coupling elements 111 of each pair is gripped by the upper and lower grip arms 18, 19 while the slide fastener chain FC1 is being fed along the chain path CP. Accordingly, in response to the continued feeding of the slide fastener chain FC1, the rows of partly interengaged coupling elements 111 are brought into mutual interengagement with each other by the slider S1 until the slider S1 is engaged by the second end stops ES2, ES2. Thus, the slider arresting mechanism 3 serves also as a chain closing mechanism. When the upper and lower grip arms 18, 19 are retracted from the chain path CP, the spacing between the upper and lower grip arms 18, 19 is large enough to permit the passage therethrough of the sliders S1, S2 on the slide fastener chain FC1 as well as the passage of the feedout mechanism 1 being advanced toward the feed mechanism 5.

Figure 5:
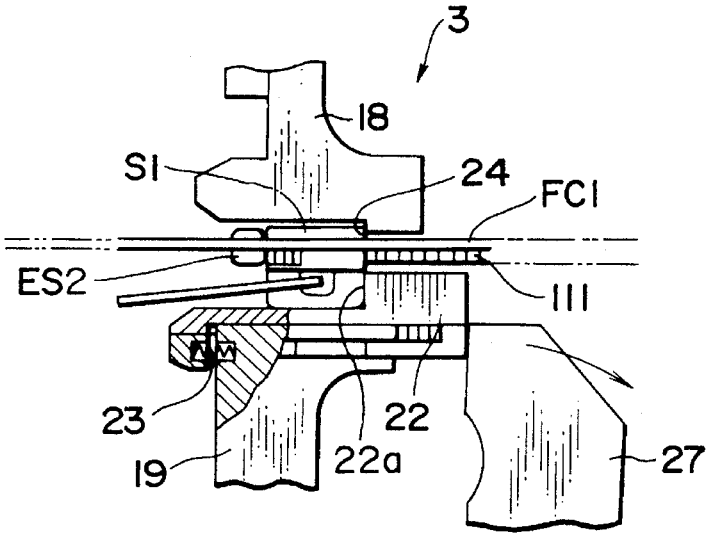
FIG. 5 is a fragmentary front elevational view, with parts in broken away for the sake of clarity, illustrative of the condition in which the detecting mechanism is activated in response to the engagement between an end stop and a slider being arrested by the slider arresting mechanism.

The lower grip arm 19 in the illustrated embodiment is so constructed as to cooperate with the detecting mechanism 4 described later. As shown in FIG. 4, the lower grip arm 19 supports on its upper surface an L-shaped slider arresting seat 22 facing toward the chain path CP. The slider arresting seat 22 is slidably movable along the chain path CP and it is normally urged in a direction opposite to the direction of feed of the slide fastener chain by means of a compression coil spring 23 acting between the slider arresting seat 22 and a body of the lower grip arm 19. With the slider S1 held on the slider arresting seat 22, the slider arresting seat 22 is movable against the force of the compression coil spring 23 to a downstream position indicated by the phantom line in FIG. 4, thereby forcing the a part of the detecting mechanism 4 in a direction indicated by the arrow shown in FIG. 5. When the slider arresting seat 22 is disposed in the phantom-lined displaced position shown in FIG. 4, one element-free gap 112 (FIG. 7) to be severed of the slide fastener chain FC1 is located at the predetermined position in the cutting mechanism 2.

The upper grip arm 18 has a stepped lower surface facing downward and having a shoulder 24 which is displaced from a step 22*a* (FIG. 4) of the L-shaped slider arresting seat 22 in a downstream direction of the chain path CP so as to enable the slider arresting seat 22 to move from the solid-lined original position to the phantom-lined displaced position of FIG. 4.

The spring force of the compression coil spring 23 is determined such that the compression coil spring 23 is able to retain the slider arresting seat 22 in the solid-lined original position, with the slider S1 held on the slider arresting seat 22, until the slider S1 is engaged by the second end stops ES2, ES2 during the feed of the slide fastener chain FC1, and the further movement of the slide fastener chain FC1 forces the second end stops ES2, ES2 to displace slider S1 and the slider arresting seat 22 in a direction of feed of the slide fastener chain CF1 against the force of the compression coil spring 23. With the spring force thus determined, the element-free gaps 112 (FIG. 7) can accurately be positioned relative to the cutting mechanism 2.

Figure 3:
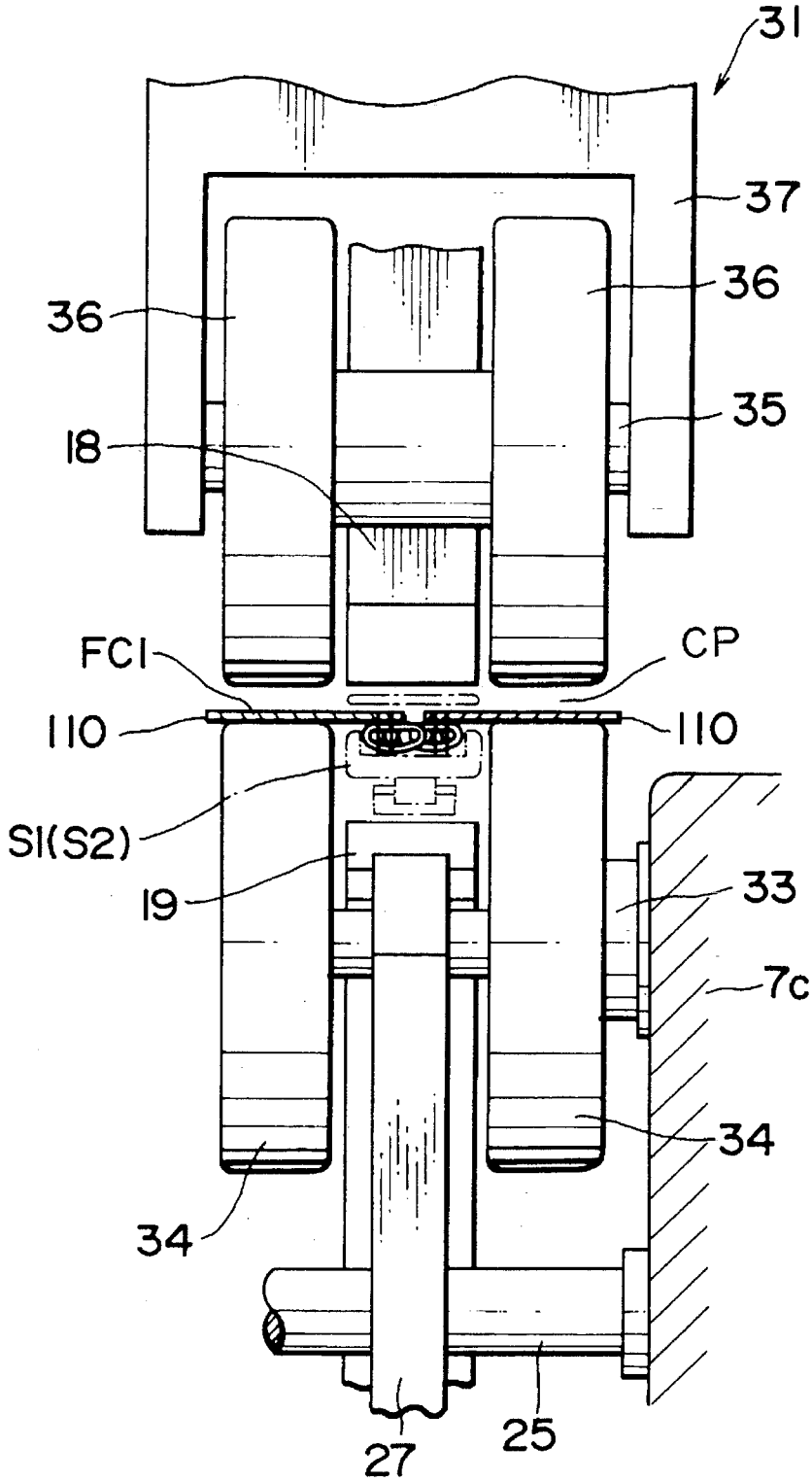
FIG. 3 is an enlarged cross-sectional view taken along line III—III of FIG. 1.

The detecting mechanism 4 is operative to detect the arresting of the slider S1 by the slider arresting mechanism 3 and, upon detection, issues a command signal to stop the feed of the slide fastener chain FC1 and activate the cutting mechanism 2. As shown in FIGS. 1, 3 and 4, the detecting mechanism 4 includes a lever 27 rotatably supported at its central portion on a horizontal shaft 25 mounted on a frame portion 7*c*. The lever 27 has an upper end located near a downstream end of the slider arresting seat 22 of the slider arresting mechanism 3, and a lower end located near a photosensor 26 attached to the frame portion 7*c*. A tension coil spring 28 acts between the lower end of the lever 27 and the frame portion 7*c* to turn the lever 27 counterclockwise (FIGS. 1 and 4) to urge the upper end toward the slider arresting seat 22. When the slider arresting seat 22, with the slider S1 held thereon, is displaced from the solid-lined position to the phantom-lined position in FIG. 4, the lever 27 turns clockwise about the shaft 25 against the force of the tension coil spring 28, as indicated by the solid lines shown in the same figure. In response to this clockwise movement of the lever 27, a light blocking plate 29, which is attached to the lower end of the lever 27, retracts from a space between a light projector 26*a*and a photocell 26*b* of the photosensor 26, thereby opening or completing a light path running from the light projector 26*a* to the photocell 26*b*. Thus, the slider S1 arrested by the slider arresting mechanism 3 can be detected by the photosensor 26. The light blocking plate 29 normally projects in a space between the light projector 26*a* and the photocell 26*b*, there de-activating the photosensor 26. Designated by 30 shown in FIGS. 1 and 4 is a stopper which limits an end of the pivotal movement of the lever 29 in the counterclockwise direction.

The feed mechanism 5 is operative to receive the slide fastener chain FC1 fed out from the feedout mechanism 1 and further advance the slide fastener chain FC1 along the chain path CP. In addition, the feed mechanism 5 is also operative to discharge a cut or finished slide fastener SF (FIG. 7) from the apparatus A. The feed mechanism 5 in the illustrated embodiment is composed of a first feed unit 31 and a second feed unit 32 disposed in tandem relation along the chain path CP, with the first feed unit 32 located closer to the cutting mechanism 2 than the second feed unit 32.

The first feed unit 31 comprises, as shown in FIGS. 1 and 3, a pair of lower feed rollers 34, 34 fixedly mounted on a drive shaft 33, and a pair of upper press rollers 36, 36 rotatably mounted on a shaft 35, in vertical confrontation with the corresponding feed rollers 34, 34 across the chain path CP. The feed and press rollers 34, 36 are held against the stringer tapes 110 of the slide fastener chain FC1, and the feed rollers 34 and the press rollers 36 of each pair are spaced laterally from each other so as not to interfere with the sliders S1, S2 and to accommodate or receive the slider arresting mechanism 3 and the detecting mechanism 4, as shown in FIGS. 1 and 3. The drive shaft 33 is rotatably supported by the frame portion 7*c* and connected to a suitable drive means (not shown) such as an electric motor. The shaft 35 is supported by a holder 37 which is urged downwardly by a compression coil spring 38 (FIG. 1) to lower the press rollers 36, 36 toward the feed rollers 34, 34 for feeding the slide fastener chain FC1, with the stringer tapes 110, 110 gripped between the feed and press rollers 34, 36. The press rollers 36 are normally positioned upwardly away from the feed rollers 34. The feed rollers 34, 34 are driven continuously, and when the slide fastener chain FC1 is to be fed, the press rollers 36 are lowered toward the feed rollers 34, 34. The feed rollers 34 are driven to feed the slide fastener chain FC1 at a low speed (first speed) so the first feed unit 31 can reliably receive the leading end of the slide fastener chain FC1 being fed out by the feedout mechanism 1 and subsequently transfer the slide fastener chain FC1 to the second feed unit 32.

As shown in FIG. 1, the second feed unit 32 comprises a pair of lower feed rollers 40 fixedly mounted on a drive shaft 39, and a pair of upper press rollers 42 rotatably mounted on a shaft 41, in vertical confrontation with the feed rollers 40 across the chain path CP. Though not shown, the feed rollers 40 and the press rollers 42 of each pair are spaced laterally from each other by a distance which is slightly larger than the maximum width of the sliders S1, S2. The drive shaft 39 is supported by the frame portion 7*c* and connected to a suitable drive means (not shown) such as an electric motor. The shaft 41 is supported by a holder 43 which is urged downwardly by a compression coil spring 44 to lower the press rollers 42 toward the feed rollers 40 for feeding the slide fastener chain FC1, with the stringer tapes 110, 110 gripped between the feed and press rollers 40, 42. The press rollers 42 are normally positioned upwardly away from the feed rollers 40. The feed rollers 40 are driven continuously, and when the slide fastener chain FC1 is to be fed, the press rollers 42 are lowered toward the feed rollers 40. The feed rollers 40 are driven to feed the slide fastener chain FC1 at a high speed (second speed) which is higher than the first speed.

The drive shaft 39 of the second feed unit 32 is connected to the non-illustrated drive means via a brake mechanism (not shown). The brake mechanism is operatively connected with the detecting mechanism 4 such that when the arresting of the slider S1 by the slider arresting mechanism 3 is detected by the detecting mechanism 4, the detecting mechanism 4 activates the brake mechanism to stop the rotation of the drive shaft 39 and the feed rollers 40. In this instance, the press rollers 42 are held in their descended position so that the slide fastener chain FC1 is gripped by the feed and press rollers 40, 42. While keeping this condition, the cutting mechanism 2 is operated to cut or sever the slide fastener chain FC1.

As shown in FIG. 1, the chain feed mechanism 6 is disposed upstream of the feedout mechanism 1 for forcing or positively feeding the slide fastener chain FC1 toward the feedout mechanism 1 to release an undue tension on the slide fastener chain FC1 which may be applied when the slide fastener chain FC1 is being fed by the feedout mechanism 1 via the cutting mechanism 2 to the feed mechanism 5 and when the slide fastener chain FC1 is being fed by the feed mechanism 5. With the chain feed mechanism 6 thus provided, the slide fastener chain FC1 can be fed smoothly and reliably along the chain path CP without damage. The chain feed mechanism 6 includes a pair of laterally spaced first guide rollers 45 (one being shown), a pair of laterally spaced second guide rollers 46 (one being shown) spaced from the first guide rollers 45 in a downstream direction along the chain path CP, and a pair of laterally spaced drive rollers 47 (one being shown) disposed between the first guide rollers 45 and the second guide rollers 46. The slide fastener chain FC1 extends zigzag or meanderingly around the first guide rollers 45, the drive rollers 47 and the second guide rollers 46 such that a longitudinal portion of the slide fastener chain FC1 extending between the first and second guide rollers 45, 46 is bent or flexed into a substantially U-shape along a lower portion of the respective peripheries of the guide rollers 47. The drive roller 47 is continuously rotated in a direction indicated by the arrow in FIG. 1

With the chain feed mechanism 6 thus constructed, when the slide fastener chain FC1 while being fed is subjected to an undue tension, the slide fastener chain FC1 is pulled into pressure contact with the respective peripheries of the continuously rotating drive rollers 47. Thus, a rotational force of the drive rollers 47 is transmitted to the slide fastener chain FC1, thereby positively feeding or forcing the slide fastener chain FC1 in a downstream direction. Thus, an undue tension on the slide fastener chain FC1 is released. Similarly, when the feedout mechanism 1 is activated to feed the slide fastener chain FC1, the slide fastener chain FC1 is momentarily stretched or tensioned. In this instance, however, a tension on the slide fastener chain FC1 is released by the chain feed mechanism 6 with the result that the slide fastener chain FC1 can be smoothly and reliably fed by the feedout mechanism 1. The first guide rollers 45, the second guide rollers 46 and the drive rollers 47 of each pair are spaced laterally from each other by a distance at least equal to the width of the sliders S1, S2 so that the first and second guide rollers 45, 46 and the drive rollers 47 will not contact the sliders S1, S2. When the slide fastener chain FC1 is not stretched or tensioned, the slide fastener chain FC1 is held in light contact with the peripheries of the drive rollers 47 so that a rotational force of the drive rollers 47 is not transmitted to the slide fastener chain FC1. In addition, since the chain path CP is horizontal, a portion of the slide fastener chain FC1 extending around the lower portion of the drive rollers 47 tends to separate from the drive rollers 46 by the force of gravity. Thus, the slider fastener chain FC1 is prevented from dragging along in the direction of rotation of the drive rollers 47 due to a friction between the slide fastener chain FC1 and the continuously rotating drive rollers 47.

The individual mechanisms 1–6 of the apparatus A are operatively interlocked with each other so as to enable the apparatus A to perform an automated slide fastener finishing operation.

When a slide fastener chain to be processed on the apparatus A has two or more sliders threaded on each pair of rows of coupling elements, the slider arresting mechanism 3 is operated to arrest one of the sliders which is located near the trailing end of each pair of coupling element rows of the slide fastener chain being advanced. In order to process such slide fastener chain, a control system of the apparatus A is provided with a timer (not shown) which is operative to set a predetermined period of time when the feedout mechanism 1 starts feeding the slide fastener chain toward the feed mechanism 5, and reset when one or more sliders which are located ahead of the slider disposed near the trailing end of the paired coupling element rows have passed through a working region of the slider arresting mechanism. Upon expiration of the predetermined time period, the timer activates the slider arresting mechanism 3, thereby enabling the slider arresting mechanism 3 to arrest the slider located near the trailing end of each pair of coupling element rows.

When the apparatus A is used with a slide fastener chain of the type having only one slider on each pair of rows of coupling elements, the aforesaid timer is not necessary and the slider arresting mechanism 3 is operated in timed relation to the other mechanism in accordance with a predetermined sequence of operation.

The operation of the slide fastener finishing apparatus A will be described below with reference to FIGS. 6A through 6F.

Figure 6A:
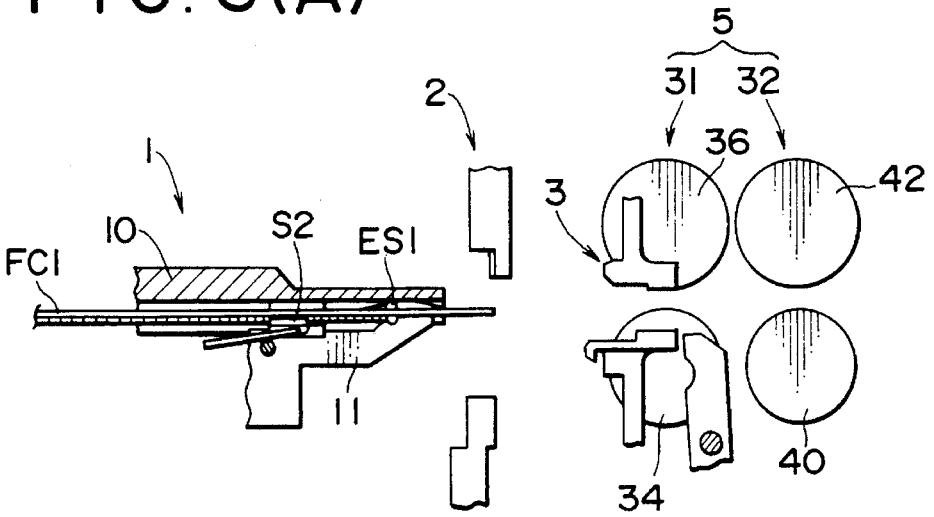
FIGS. 6A through 6F are diagrammatical partly cross-sectional views showing a sequence of operation of the slide fastener finishing apparatus.

FIG. 6A shows the standby state or condition of the apparatus A from which operation of the apparatus A starts. In this standby condition, the slide fastener chain FC1 is set in the apparatus A with pull tabs on the sliders (only one S2 being shown) facing downwardly and the first separate end stops ES1 ahead of the second separate end stops ES2 (see FIG. 6C) in the direction of travel along the chain path PC (FIG. 1). The slide fastener chain FC1 is gripped by the bearing plate 10 and the grippers 11 with the leading end positioned in the cutting mechanism 2. The feedout mechanism 1 is in the retracted position. The cutting mechanism 2 and the slider arresting mechanism 3 are deactivated. The respective feed rollers 34, 40 of the first and second feed units 31, 32 of the feed mechanism 5 are rotating, and the press rollers 36, 42 are disposed in the upper position.

Figure 6B:
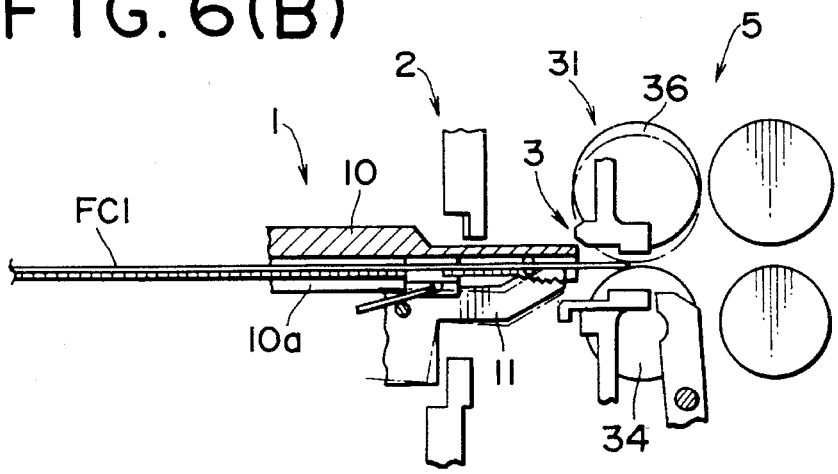

Then, the feedout mechanism 1 is advanced to the position of FIG. 6B to move the leading end of the slide fastener chain FC1 past the cutting mechanism 2 to the first feed unit 31 of the feed mechanism 5. Upon arrival of the leading end at the first feed unit 31, the cylinder actuator 13 (FIG. 1) is activated to retract its piston rod 13*a* (FIG. 1), thereby turning the grippers 11 clockwise to the phantom-lined position shown in FIG. 6B. Thus, the slide fastener chain FC1 is released from the grippers 11 and the bearing plate 10. At the same time, the press rollers 36 are lowered toward the feed rollers 34, as indicated by the phantom line in FIG. 6B.

Figure 6C:
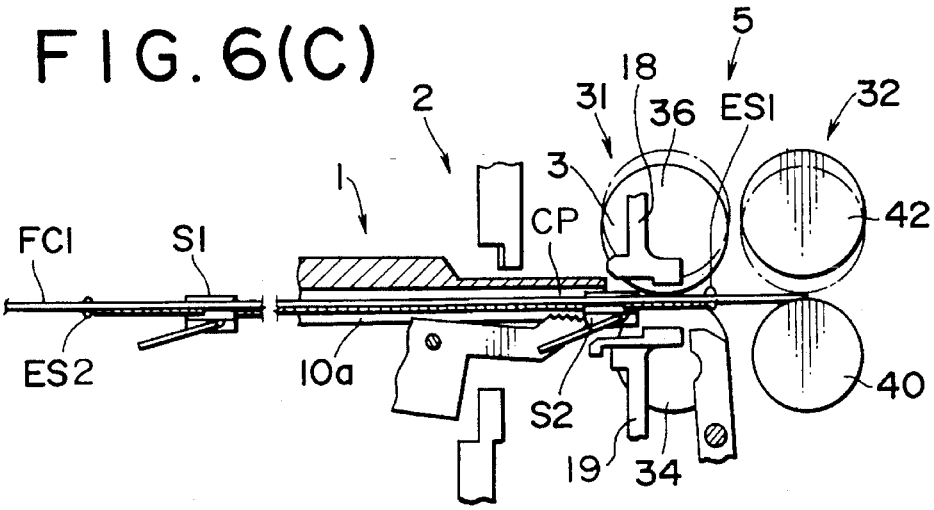

The downward movement of the press rollers 36 causes the press rollers 36 and the feed rollers 34 to grip and feed the slide fastener chain FC1 along the chain path to the second feed unit 32, as shown in FIG. 6C. When the leading end of the slide fastener chain FC1 arrives at the second feed unit 32, the press rollers 36 of the first feed unit 31 are moved upwardly away from the feed rollers 34. At the same time, the press rollers 42 of the second feed unit 32 are lowered toward the continuously rotating feed rollers 40. Thus, the slide fastener chain FC1 is gripped and fed by the feed rollers 40 and the presser rollers 42 in a downstream position along the chain path at a second, high speed. During that time, the first separate end stops ES1 and the slider S2, which are located adjacent to the leading end of the slide fastener chain FC1, move successively past the cutting mechanism 2 and the slider arresting mechanism 3 to a downstream side of the second feed unit 42. Immediately after the passage of the slider S2 through the slider arresting mechanism 3, the cylinder actuators 20, 21 (FIG. 1) are activated to move the upper and lower grip arms 18, 19 toward each other until they arrive at a arresting position located close to the chain path CP (FIG. 1).

Figure 6D:
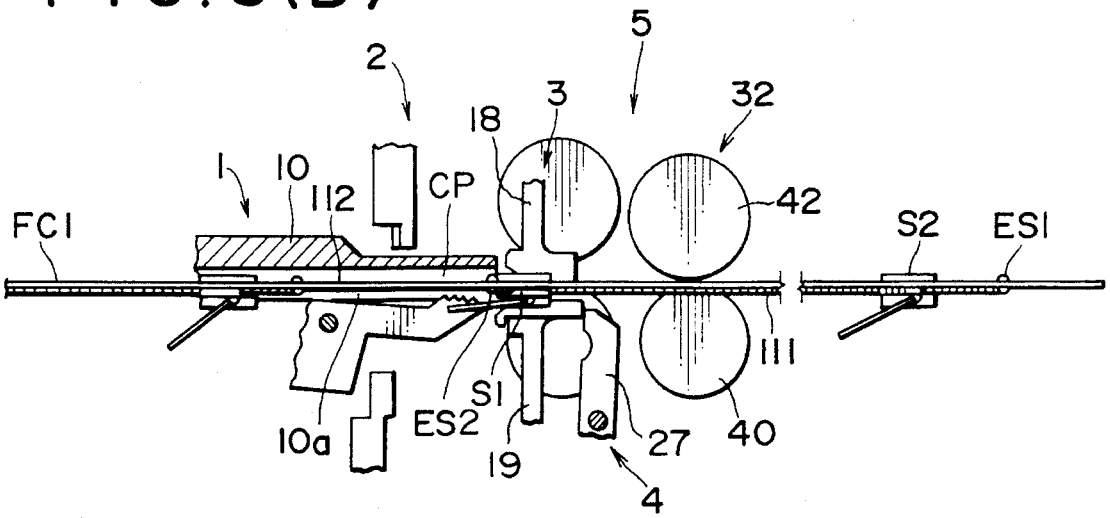
Figure 6E:
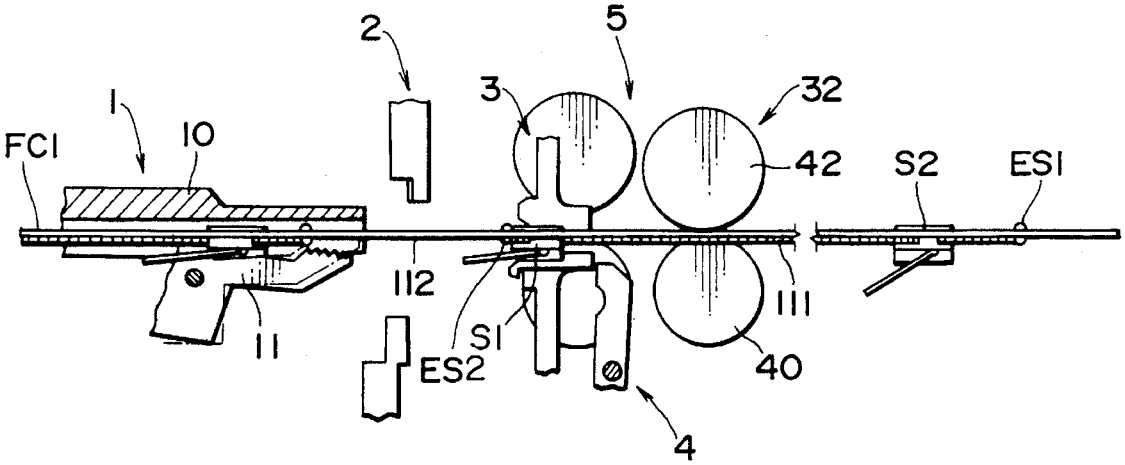

The continued feeding of the slide fastener chain FC1 causes the slider S1 to be arrested by the upper and lower grip arms 18, 19 of the arresting mechanism 3 against the downstream movement, thereby intermeshing the uncoupled elements 111 on the slide fastener chain FC1 as the latter travels. A further movement of the slide fastener chain FC1 causes the second separate end stops ES2 to engage the slider S1 being arrested by the slider arresting mechanism 3 and then displace the slider arresting seat 22 (FIGS. 4 and 5) in the downstream direction via the slider S1, thereby turning the lever 27 of the detecting mechanism 4 in the clockwise direction, as shown in FIGS. 6D. With this angular movement of the lever 27, the arresting of the slider S1 by the slider arresting mechanism 3 is detected by the detecting mechanism 4. At this time, the element-free space 112 located adjacent to the second separate end stops ES2 is located at a predetermined position in the cutting mechanism 2. Up to the detection of the arrested slider S1, the feedout mechanism 1 is held immovable at the advanced position so that the slide fastener chain FC1 can be stably guided along the guide walls 10*a*, 10*a* (FIG. 2) of the feedout mechanism 1, and the slider S1 can be guided accurately into the slider arresting mechanism 3.

Upon detection of the arresting of the slider S1 by the slider arresting mechanism 3, the detecting mechanism 4 operates to stop the rotation of the feed rollers 40 of the second feed unit 32 via the non-illustrated brake mechanism, thereby temporarily suspending the feed of the slide fastener chain FC1. In this instance, the press rollers 42 are held in the lowered position so that the slide fastener chain FC1 is gripped by the feed rollers 40 and the press rollers 42 of the second feed unit 32. At the same time, the feedout mechanism 1 is retracted to the position of FIG. 6E, and after that the grippers 11 are activated by the cylinder actuator 13 (FIG. 1) for gripping the slide fastener chain FC1 by the gripers 11 and the bearing plate 10.

Figure 6F:
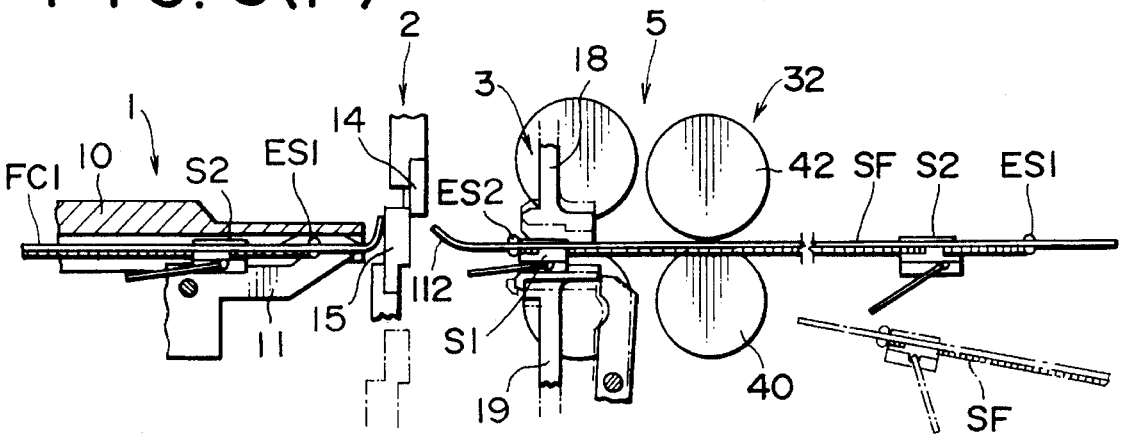

Subsequently, the movable lower cutter blade 15 of the cutting mechanism 2 is lifted toward the fixed upper cutter blade 14, as shown in FIG. 6F. As a result, the slide fastener chain FC1 is cut off across the element-free gap 112 between the longitudinally spaced pairs of end stops ES2, ES1. Then, the lower cutter 15 is lowered below the chain path. Simultaneously, the upper and lower grip arms 18, 19 are retracted away from each other by the respective cylinder actuators 20, 21 (FIG. 1). Then, the braking force acting on the feed rollers 40 of the second feed unit 32 is released whereupon the feed rollers 40 resume rotation at the second, high speed. Accordingly, the feed rollers 40 and the press rollers 42 coact to discharge the cut or finished slide fastener SF from the apparatus A. When the finished slide fastener SF is discharged, the press rollers 42 are moved upwardly away from the feed rollers 40.

The foregoing cycle of operation will be repeated until a predetermined number of slide fasteners SF are cut off from the slide fastener chain FC1.

In the slide fastener finishing apparatus A of the present invention, each of the longitudinally spaced ele- ment-free gaps of the slide fastener chain is accurately positioned relatively to a predetermined position in the cutting mechanism by means of the slider arresting mechanism which is operative to arrest a slider, with the slider engaged by an end stop located adjacent to the element-free gap. The apparatus A having such slider arresting mechanism can be used not only with the slide fastener chain shown in FIG. 7 but also with those shown in FIGS. 8 through 11.

Figure 8:
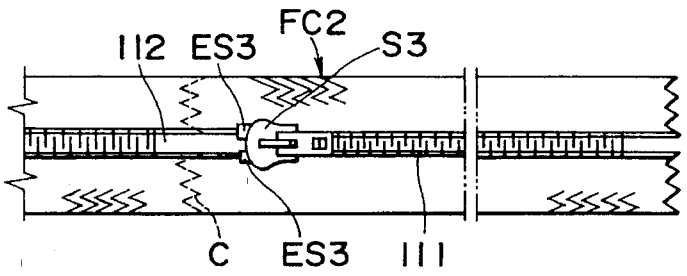

The slide fastener chain FC2 shown in FIG. 8 includes only one slider S3 threaded on each pair of rows of coupling elements 111, and a pair of separate end stops ES3, ES3 secured to one end of the coupling element rows 111 toward which the slider S3 is movable to intermesh or close the coupling element rows 111. The opposite end of the coupling element rows 111 is devoid of an end stop.

Figure 9:
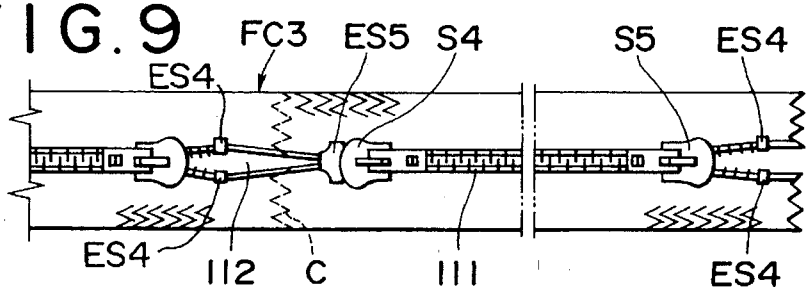

The slide fastener chain FC3 illustrated in FIG. 9 comprises two sliders S4 and S5 threaded back-to-back on each pair of rows of coupling elements 111, a pair of separate end stops ES4, ES4 secured at one end of the coupling element rows 111, and a bridge type end stop ES5 secured to the opposite end of the coupling element rows 111. A portion of the coupling element rows 111 extending between the slide fastener S4 and the bridge type end stop ES5 can be opened and closed in response to the movement of the slider S4 toward and away from the end stop ES5.

Figure 10:
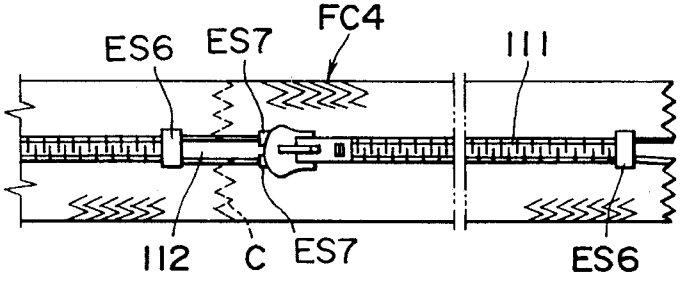

The slide fastener chain FC4 shown in FIG. 10 is similar to one shown in FIG. 8 but differs therefrom in that a bridge type end stop ES6 is secured to the opposite end of the coupling element rows 111. The slide fastener chain FC4 is set in the apparatus A with the bridge type end stop ES6 ahead of a pair of separate end stops ES7. The slide fastener chain FC4 can also be processed by the prior slide fastener finishing apparatus discussed above.

Figure 11:
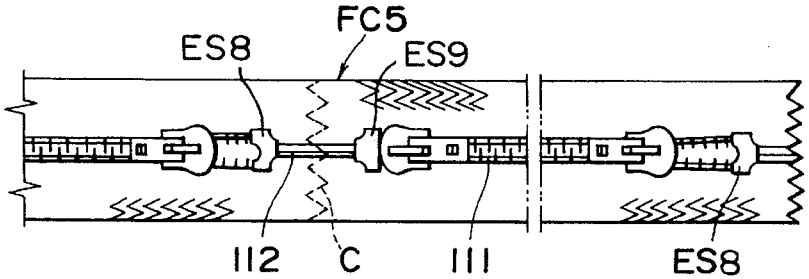

The slide fastener chain FC5 illustrated in FIG. 11 is similar to one shown in FIG. 9 but differs therefrom in that a pair of bridge type end stops ES8 and ES9 are secured to the opposite ends of each pair of rows of coupling elements 111. The slide fastener chain FC5 is set in the apparatus A with the end stop ES8 ahead of the end stop ES9. The slide fastener chain FC5 can also be processed by the prior slide fastener finishing apparatus disclosed in the U.S. patent publications specified above.

In FIGS. 8 through 11, reference character C denotes a cutting line along which each of the slide fastener chains FC2–FC5 is cut off by the cutting mechanism 2 of the apparatus A.

As is apparent from the foregoing description, the apparatus of the present invention is able to process those slide fastener chains which can not be processed by the prior apparatus. According to the invention, each of the element-free gaps is placed in a predetermined position in the cutting mechanism when an end stop is engaged by a slider while the slide fastener chain is being fed, with the slider temporarily arrested by the slider arresting mechanism. Such an abutting engagement between the end stop and the slider is usually experienced during the use of the slide fastener, so even if a bridge type end stop is used, the end stop is completely free from damage or deformation. This arrangement offers a great contrast to the conventional apparatus in which a bridge end stop is likely to deform due to abutment with a thin blade-like chain stopper which is projected in each of the element-free gaps.

The present invention may be practiced or embodied in still other ways without departing from the spirit or essential character thereof. For instance, the chain path may be vertical and a cooperating pair of feed and press rollers can be used in place of the feedout mechanism including grippers and the bearing plate, for gripping and feeding the slide fastener chain along the vertical chain path to the feed mechanism. In addition, the first and second feed units arranged in tandem relation along the chain path may be replaced with a single feed unit composed of a pair of laterally spaced feed rollers and a pair of laterally spaced press rollers movable toward and away from the feed rollers. Furthermore, the feedout mechanism may be fixed, and the slide fastener chain is fed along the chain path by pulling the leading end thereof by a gripper which is disposed downstream of the cutting mechanism and reciprocally movable toward and away from the feedout mechanism across the cutting mechanism.

Obviously, various modifications and variations of the present invention are possible in the light of the above teaching. It is therefore to be understood that within the scope of the appended claims the invention may be practiced otherwise than as specifically described.

What is claimed is:

1. An apparatus for finishing slide fasteners by cutting an elongate slide fastener chain across longitudinally spaced element-free gaps, the slide fastener chain having a plurality of pairs of rows of coupling elements longitudinally spaced by the element-free gaps, at least one slider slidably mounted on each pair of the rows of coupling elements, and an end stop mounted on one end of the coupling element rows of each pair and engageable with the slider when the slider moves in a direction to interengage the coupling element rows, said apparatus comprising:

(a) a cutting mechanism for cutting the slide fastener chain across one of the element-free gaps to produce a slide fastener;

(b) a feed mechanism disposed downstream of said cutting mechanism for feeding the slide fastener chain along a path of travel;

(c) a feedout mechanism disposed upstream of said cutting mechanism for feeding the slide fastener chain past said cutting mechanism to said feed mechanism, with a respective other end of the coupling element rows downstream of said one end thereof carrying thereon the end stop;

(d) a slider arresting mechanism disposed between said cutting mechanism and said feed mechanism and movable into and out of said path of travel of the slide fastener chain for temporarily arresting the slider against downstream movement while the slide fastener chain is being fed by said feed mechanism; and (e) a detecting mechanism operatively connected with said slider arresting mechanism for detecting the engagement between the end stop and the slider which occurs when the slide fastener chain is fed by said feed mechanism while the slider is being arrested by said slider arresting mechanism, said detecting mechanism being operative, upon detection of said engagement between the end stop and the slider, to stop the operation of said feed mechanism to terminate the feed of the slide fastener chain and activate said cutting mechanism for cutting the slide fastener chain;

wherein said slider arresting mechanism includes a pair of grip arms disposed on opposite sides of said path of travel of the slide fastener chain and movable toward and away from each other to grip the slider therebetween, one grip arm of said pair of grip arms having an L-shaped slider arresting seat slidably mounted on a body of said one grip arm and having a step engageable with a portion of the slider, and a spring means for urging said slider arresting seat in a first direction opposite to a direction of feed of the slide fastener chain, said slider arresting seat being displaceable against the force of said spring means in said direction of feed of the slide fastener when the slide fastener chain is fed, with the end stop engaged by the slider being supported on said slider arresting seat, and wherein said detecting mechanism is responsive to said displacement of said slider arresting seat in said direction of feed of the slide fastener chain.

2. An apparatus according to claim 1, wherein the other of said pair of grip arms includes a stepped surface having a shoulder engageable with a portion of the slider, said shoulder being normally displaced from said step of said slider arresting seat in said direction of feed of the slide fastener chain, said shoulder being aligned with said step when said slider arresting seat is displaced.

3. An apparatus according to claim 1, wherein said detecting mechanism includes a lever having a first end engageable with said slider arresting seat, and a photosensor disposed near a second end of said lever opposite said first end, said photosensor being activated when said lever is turned in one direction by said slider arresting seat.

4. An apparatus according to claim 1, further including a chain feed mechanism disposed upstream of said feedout mechanism for positively feeding the slide fastener chain toward said feedout mechanism to release an undue tension on the slide fastener chain applied while the slide fastener chain is fed by said feedout mechanism or said feed mechanism.

5. An apparatus according to claim 4, wherein said chain feed mechanism includes a first guide roller, a second guide roller spaced downstream from said first guide roller along said path, and a continuously rotating drive roller disposed between said first and second guide rollers, said first and second guide rollers and said drive roller being arranged such that the slide fastener chain extends meanderingly around said first guide roller, said drive roller and said second guide roller, with a portion of the slide fastener chain spanning between said first and second guide rollers being flexed into a U-shape along a portion of the periphery of said drive roller.

6. An apparatus according to claim 5, wherein said path of travel of the slide fastener chain is horizontal, and said portion of the periphery of said drive roller is a lower portion of said drive roller.

7. An apparatus according to claim 1, said feed mechanism is composed of a first feed unit and a second feed unit disposed in tandem relation along said path of travel of the slide fastener chain, said first feed unit being disposed closer to said cutting mechanism than said second feed unit and operative to feed the slide fastener chain at a first speed, said second feed unit being operative to feed the slide fastener chain and each of the slide fasteners at a second speed higher than said first speed.

* * * * *